US005586416A

United States Patent [19]

Hess, III et al.

[11] Patent Number: 5,586,416

[45] Date of Patent: Dec. 24, 1996

[54] CONCRETE FORM WITH INTEGRAL DRAIN

[76] Inventors: John Hess, III, 1813 S. 11th; Harold Hess, 17 Lakewood Dr., both of Belleville, Ill. 62223

[21] Appl. No.: 408,535

[22] Filed: Mar. 22, 1995

[51] Int. Cl.[6] ..... E02D 19/00

[52] U.S. Cl. ..... 52/169.5; 249/5

[58] Field of Search ..... 52/699, 700, 701, 52/169.1, 169.5, 169.8, 169.13, 292, 294, 295; 249/3, 4, 5, 141; 425/84

[56] References Cited

U.S. PATENT DOCUMENTS

| | | |
|---|---|---|
| 1,007,557 | 10/1911 | Graham . |
| 1,495,353 | 5/1924 | Otto . |
| 1,625,838 | 4/1927 | White . |
| 1,880,706 | 10/1932 | Bitney . |
| 2,278,917 | 4/1942 | Curry . |
| 2,978,840 | 4/1961 | Tatsch . |
| 3,017,722 | 1/1962 | Smith . |
| 3,226,935 | 1/1966 | Schneller . |
| 3,460,859 | 8/1969 | Keating . |
| 3,572,001 | 3/1971 | Munchinsky . |
| 3,613,323 | 10/1971 | Hreha . |
| 3,668,829 | 6/1972 | Nelson . |
| 3,676,967 | 7/1982 | Frati . |
| 3,758,062 | 9/1975 | Caldwell et al. . |
| 3,903,704 | 9/1975 | Spiridonov . |
| 4,060,954 | 12/1977 | Liuzza . |
| 4,333,281 | 6/1982 | Scarfone . |
| 4,702,048 | 10/1987 | Millman . |
| 4,733,989 | 3/1988 | Harriett . |
| 4,757,651 | 7/1988 | Crites . |
| 4,773,195 | 9/1988 | Waller . |
| 4,832,557 | 5/1989 | Jacobsen . |
| 4,840,515 | 6/1989 | Freese . |
| 4,858,958 | 8/1989 | Harbeke . |
| 5,120,162 | 6/1992 | Parker . |
| 5,174,083 | 12/1992 | Mussell . |
| 5,224,799 | 7/1993 | Parker . |

OTHER PUBLICATIONS

CertainTeed Form-a-Drain™ Product Information & Advantages, Brochure, CertainTeed Corporation 1994, 12 pages.

Richmond Reinforcing Bar Supports for Concrete Construction, Brochure, Richmond Screw Anchor Co. 1978, Bulletin No. 7, 8 pages.

ACO Drain III®, System FG 200, Brochure, ACO, 4 pages.

Standard Wall Ties, Wall-Ties & Forms, Inc., 1 page.

Precise Forms, Brochure, Precise Forms, Inc., 12 pages.

Med Co, Brochure, Meadow Steel Products 1988, 20 pages.

Easy-Bucks™ Easy-Wells™, Boman Kemp, 1 page.

*Primary Examiner*—Creighton Smith

*Attorney, Agent, or Firm*—Howell & Haferkamp, L.C.

[57] ABSTRACT

A footing/foundation form with an integral drain having two substantially parallel spaced apart, serpentuitous walls. Each wall includes a plurality of hollow tubes elevated "to grade" above an excavation bottom by a stake and clip mechanism with gravel filled between the elevated tubes and the excavation bottom such that the elevated tube and gravel both engage concrete poured between the walls. The tubes are common 10-foot PVC tubes with a plurality of holes positioned away from the footing/foundation thereby providing the form with an integral drain. The stakes are preferably pieces of reinforcing bar and the clips, while quite effective, are also inexpensively manufactured.

25 Claims, 4 Drawing Sheets

CONCRETE FORM WITH INTEGRAL DRAIN

BACKGROUND AND SUMMARY OF THE INVENTION

Typical building practice requires construction of a footing or foundation upon which vertical concrete walls of a structure rest. A typical outer wall may range from 6–12 inches in thickness and the footing upon which the walls rest is typically wider than the wall width and may have a vertical depth (height) of 6–12 inches. Because these foundations are commonly a substantial distance below ground level, accumulation of water with a head of pressure at the footing level is a continuous risk. To prevent this ground water from entering the building through floor or foundation cracks, or through crevices between the foundation and basement floor, good building practice provides a means for removing the undesired ground water. Relatively standard procedures have developed over the years to construct sturdy footings/foundations and to provide a drainage system to remove future unwanted ground water.

The standard procedures include preparing a trench or excavation to the appropriate depth and dimensions to accommodate the footing/foundation forms and drainage system. Next, the inside and outside corner points of the footing/foundation wall are surveyed and a string or chalk line is placed around the intended footing/foundation perimeter. In the prior art, planks (typically 2×4–2×12-inch sections of seasoned wood) were arranged along the surveyed line and secured in place by common stakes. Because foundation forms are typically a pair of serpentuitous parallel walls, the prior art planks were cut to appropriate lengths using either mitered ends or special corner pieces to maintain the parallel relationship throughout the footing/foundation perimeters. After completing the entire footing/foundation network, concrete was poured between the forms, appropriately screeded, and allowed to set. When the concrete was sufficiently hard (typically the next day), the prior art forms were removed and a drainage system was installed thereafter.

A typical drainage system includes drain tiles having a plurality of apertures to allow water to enter the tiles. The prior art drain tiles were positioned adjacent the footing/foundation and were typically in fluid communication with either a sewer, a dry well, or a sump pump to remove the undesired ground water from around the footing/foundation. It was also customary to place gravel or filler stone around and over the drain tile to create a leach field thereby assisting water to flow into the drain tile.

The labor intensive nature of this prior art technique and the cost associated with purchasing form materials (planks/stakes) as well as drain tiles added significant expense to the typical construction project. Removing the form materials (planks/stakes) after sufficient hardening of the footing/foundation is a tedious practice. Installing an independent drainage system is also a costly and labor intensive procedure. Once the forms are removed, a certain amount of retrenching is required to assure proper positioning of the drain tiles adjacent the footing/foundation and at the appropriate depth within the excavation. If construction has started on the structure (as is typically the case), backfill and debris between the footing/foundation and the excavation walls will have undoubtedly accumulated. Removal of this backfill and debris requires hand shoveling, which escalates the prior art labor costs associated with laying the drainage systems. Moreover, due to the risk of injury, the Occupational Safety and Health Administration (OSHA) prohibits human activity within certain types/depths of trenches until the walls are shored. Thus, as well as introducing additional opportunity for injury, the costly prior art step of removing backfill and debris by hand shoveling may also violate OSHA regulations.

Moreover, the prior art drain tiles are typically laid directly on the excavation bottom with various tile apertures positioned in close proximity to the excavation bottom. Over time, silt and sediment tend to gravitate through the gravel leach field and accumulate on the excavation bottom adjacent the drain tiles which may block the tile apertures and hinder water drainage. Further, the close proximity of the tile apertures to the excavation bottom introduce the risk that silt or sediment will enter the drain tile and partially (or completely) clog the tile.

Recognizing the cost associated with the highly labor intensive prior art footing/foundation construction techniques (i.e. excavating, installing forms, pouring the footing, removing the forms, re-trenching, constructing the drainage system, laying a gravel leach field, and backfilling the excavation), attempts have been made to minimize these costs. Hreha, U.S. Pat. No. 3,613,323 and Parker, U.S. Pat. Nos. 5,120,162 and 5,224,799 each disclose foundation forms with integral drainage tiles or planks. The apparent purpose of the Hreha and Parker references is to eliminate the need for manually removing the forms after the footing/foundation is set and constructing an independent drainage system around the footing/foundation thereafter. While Hreha and Parker no longer require the entire drainage system to be separately constructed, these references require custom designed materials thereby offsetting the alleged labor savings with an increase in material costs. Parker ('162 and '799), for example, discloses custom designed planks having a precise horizontally symmetric shape and equally elaborate connectors to allow various serpentuitous patterns to be constructed. These stakes are also custom designed and molded. Moreover, as illustrated in FIGS. 3–4 of the '162 patent the Parker forms require separate solid planks in addition to the hollow foraminous standard planks to accommodate a footing/foundation of atypical depth (i.e. deeper than the height of a standard plank) thereby adding to the number and cost of materials which must be inventoried to use the Parker system. Similarly, Hreha discloses an elaborate multi-tiered form including drain tiles, mitered where appropriate, resting on the excavation bottom and a wall section positioned thereabove. The walls and tiles are both secured in position by stakes.

In addition to the material expense associated with the large inventory and custom molded drain tiles/planks, the drainage systems of both Hreha and Parker still require manual attention after the footing/foundation hardens. Similar to the prior art techniques discussed above, the wall sections and stakes of Hreha are manually removed after the concrete hardens. While the footing/foundation forms disclosed by Hreha and Parker are non-biodegradable and include an integral drain, a leach field is not created adjacent the drain tiles until after the footing/foundation concrete sets. Prematurely pouring the gravel and/or filler stone for the leach field may misalign the form which could affect the footing/foundation integrity. Therefore, contractors employing the Hreha or Parker techniques will typically wait a day or two after pouring the footing/foundation before pouring gravel therearound. Because construction sites are typically busy at this stage of the project, backfill and debris commonly accumulate in the excavation during this day or two day lag which demands an additional labor commitment to retrench the excavation prior to pouring the gravel or filler stone.

Further, as is typical with other prior art drainage systems, the Hreha and Parker drain tiles rest flush with the excavation bottom which positions the apertures therethrough in close proximity to the excavation bottom. Hreha and Parker thereby fail to address the prior art problems of aperture blockage and tile clogging caused by sediment gravitating through the leach field and accumulating at the excavation bottom.

Another problem with the prior art footing/foundation construction practice is the accurate placement of reinforcing bar within the footing/foundation. Reinforcing bar is specified in most construction projects to provide additional support to the foot/foundation. However, if the reinforcing bar is not properly positioned while the concrete is drying, much of the intended structural benefit may be sacrificed. As such, the site laborer must typically take measures to assure that the reinforcing bar does not fall to the excavation bottom or otherwise become misplaced as the concrete is poured between the forms.

The prior art reinforcing bar supports typically include either a number of simple blocks upon which the bar lays atop or a rather elaborate chair construction (i.e. the bar chair described in U.S. Pat. No. 4,060,954). The blocks, while inexpensive, are susceptible to adjustment during the concrete pouring stage which may lead to the reinforcing bar falling to the excavation bottom at one or more locations. The bar chairs, while more stable than the above-described blocks, may also adjust during the concrete pouring stage and are considerably more expensive thereby increasing the total cost of the construction project.

The present invention overcomes the foregoing problems by providing a footing/foundation form with an integral drain having two substantially parallel spaced apart, serpentuitous walls, each wall including a plurality of hollow tubes elevated "to grade" above an excavation bottom by a stake and clip mechanism with gravel filled between the elevated tubes and the excavation bottom. The tubes are connected end-to-end and preferably include a plurality of holes to enable water accumulating adjacent the footing/foundation to drain into a sewer, dry well, or sump pump. However, unlike the prior art forms having integral drainage means, the tubes of the present invention are preferably standard 10-foot PVC tubes available at many hardware and construction stores or are easily adapted from commonly available PVC tubes. The stakes are preferably pieces of reinforcing bar (or other steel rods which are readily available) and the clips, while quite effective, are inexpensively manufactured. As such, the present invention provides a footing/foundation form with integral drainage without the necessity of expensive custom molded materials which escalated the cost associated with the prior art techniques. Further, adjusting the depth (height) of the form is a simple matter of adjusting the tube, stake, and clip arrangement and adjusting the quantity of gravel placed therearound accordingly. Thus, the present invention accommodates a variety of footing/foundation parameters without the costly necessity of carrying an inventory of various supplemental solid plank sizes/shapes as with the prior art techniques.

In addition to the material cost savings, the present invention requires virtually no manual attention after the footing/foundation hardens which translates into significant labor cost savings. The gravel leach field of the present invention is intentionally created before the footing/foundation concrete is poured. In fact, the gravel is part of the concrete engaging section of the form. Because the gravel leach field is filled before the footing/foundation is poured, the possibility of backfill and/or debris accumulating around the excavation perimeter while the concrete is setting is greatly minimized. This eliminates the labor intensive necessity in the prior art to retrench the excavation perimeter after the footing/foundation hardens, which reduces labor costs. The present invention also reduces the chance for injury associated with human activity within an unshored trench and minimizes the likelihood of OSHA fines for noncompliance with its trench regulations.

Further, positioning the fluid conduit (the tubes) in spaced relation to the excavation bottom, provides several significant advantages over the prior art techniques. Because the conduit does not rest flush with the excavation bottom, the risk of silt and/or sediment (which accumulates at the excavation bottom over time) blocking the tube holes is greatly minimized. The likelihood of the tubes clogging over time is also reduced because the preferred embodiment provides several of the tube holes below the central horizontal plane of the tubes (and most preferably includes at least one hole facing substantially downward) which allows any silt and/or sediment which happens to enter the tube to gravity flow therefrom.

A cross-over pipe may also be added between the walls providing fluid communication therebetween, such that fluid within a clogged tube section in one wall may effectively drain via the cross-over pipe. Moreover, the cross-over pipes may be constructed to support a hook of various lengths therebelow. The hooks are inexpensive and will securely support reinforcing bar a desired distance above the excavation bottom, thereby addressing the prior art problems of securely and cost effectively supporting rebar within the foot/foundation.

BRIEF DESCRIPTION OF THE DRAWINGS

In the accompanying drawings which form a part of the specification and are to be read in conjunction therewith, and in which like reference numerals are used to indicate like parts in the various views.

DETAILED DESCRIPTION OF THE PREFERRED EMBODIMENT

Figure 1:
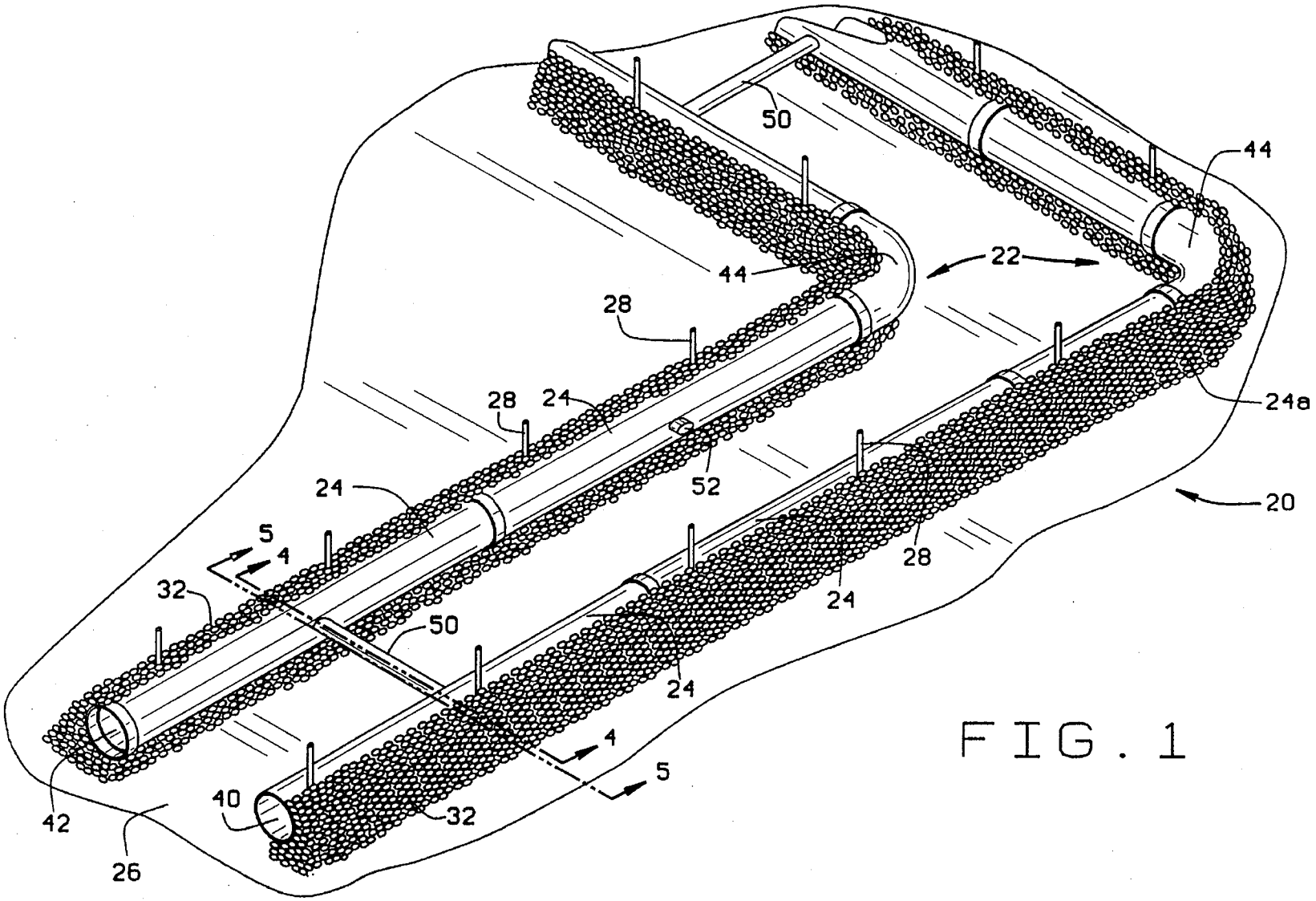
FIG. 1 is an isometric view of the footing/foundation form of the present invention with parallel, spaced apart, serpentuitous walls each comprising an elevated tube and gravel filled between the tube and the excavation bottom.

A footing/foundation form constructed according to the principles of the present invention is designated generally as 20 in FIG. 1 and includes two substantially parallel, spaced apart, serpentuitous walls 22 for retaining concrete poured therebetween. Each wall includes a plurality of hollow tubes 24 linked end to end, said tubes are secured in spaced relation to an excavation bottom 26 by a plurality of stakes 28 and clips 30 (see FIG. 2), and gravel 32 is filled beneath the elevated tubes 24.

Figure 2:
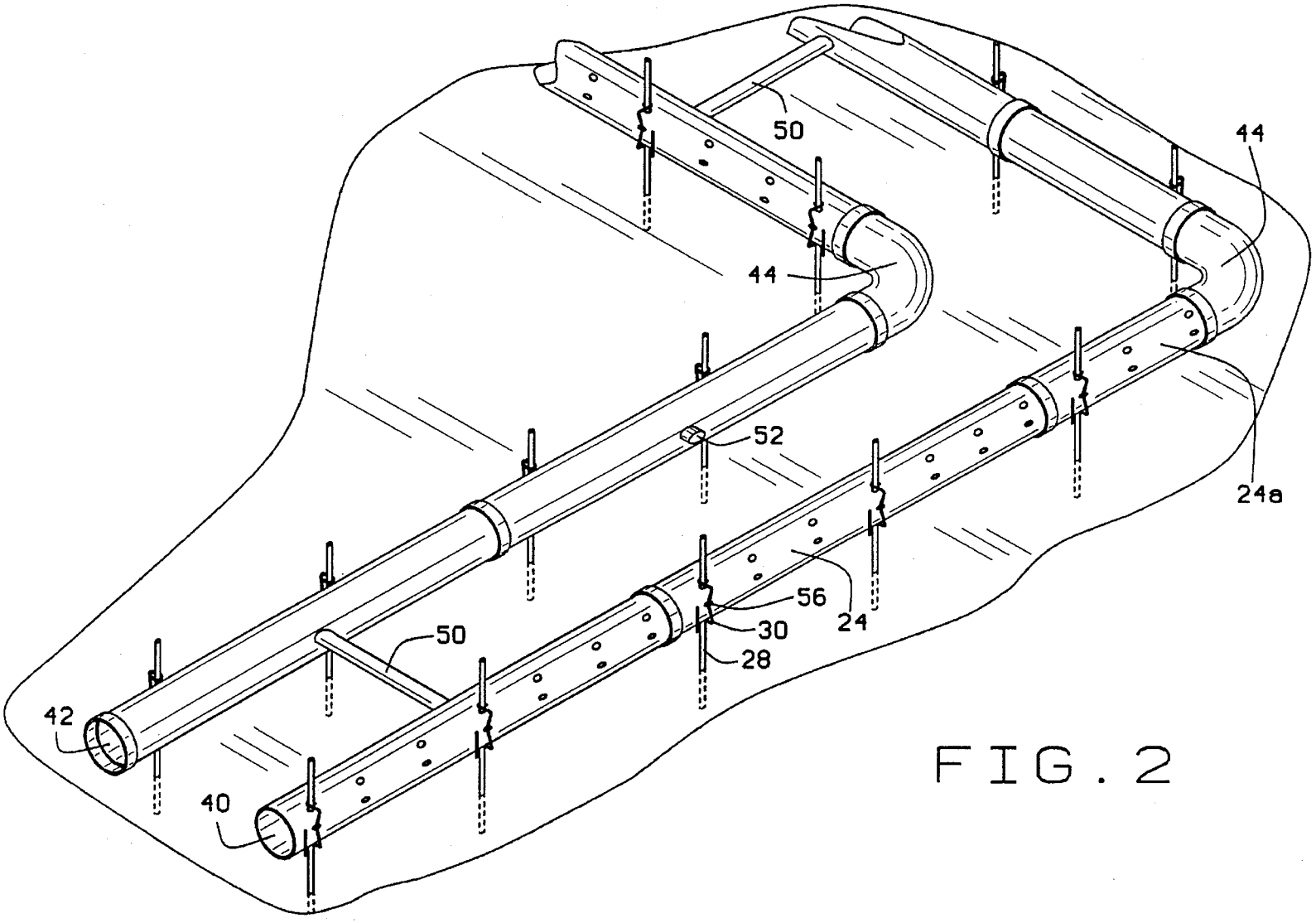
FIG. 2 is an isometric view of the present invention similar to FIG. 1 with the gravel fill removed to better illustrate the stakes and clips elevating the tubes above the excavation bottom prior to pouring the gravel filler.

The tubes 24 are preferably 10-feet long with a 4 inch diameter and include a male end 40 and a female end 42 to enable convenient end-to-end connection of the multiple tubes. Various shaped elbows 44 (i.e. 30°, 45°, 60°, 90°, etc.) are provided to enable the end-to-end connection of the tubes in a serpentuitous path. The elbows 44 preferably include two female ends which allow any tube 24 to be cut precisely where a change in wall direction is desired and the cut tube will conveniently mate with any elbow 44. Tube 24(*a*) in FIGS. 1 and 2 illustrates a tube cut to meet design specifications which conveniently mates with the 90°elbow 44.

In the preferred embodiment, each tube includes three longitudinal rows of holes 46 (see FIG. 3) arranged at approximately 30°, 90°, and 150° (viewed from the male end) and an aperture or knock out 48 (see FIG. 4) at 270°(viewed from the male end). The holes 46 are preferably ⅝ inches in diameter and spaced 5 inches center-to-center, while the aperture or knock out 48 is preferably 1½–2 inches in diameter and located an equal distance between the ends 40 and 42. As illustrated in FIGS. 1 and 2, the holes 46 face away from the footing/foundation allowing liquid therearound to enter the tubes 24 thereby providing the form 20 with integral drainage. Drain tubes (not shown) are connected periodically to the tubes 24 providing a fluid conduit to a sewer or sump pump thereby enabling liquid adjacent the footing/foundation to be removed therefrom.

The apertures or knock outs 48 are designed to accept a cross-over pipe 50. This cross-over pipe, which includes a flange or groove 51 near each of its ends, provides fluid communication between the spaced apart walls 22 thereby allowing fluid within a clogged tube section in one wall to effectively drain via the cross-over pipe 50. However, the cross-over pipe 50 is optional. If the site worker chooses not to use these cross-over pipes (or to only use a few cross-over pipes periodically) caps 52 may be used to cover the apertures 48 such that poured concrete does not flow into the tubes 24. As mentioned above, the tubes 24 may be manufactured with a knock out in place of the apertures 48. A knock out comprises a number of perforations outlining the shape of aperture 48. With this construction, to use a cross-over pipe 50, the site worker would simply punch the knock-out with a screw driver (or similar tool) to remove the cover and the tube would be structurally equivalent the tubes described above. However, if a cross-over pipe is not desired at particular locations, the knock out is left in place—thereby minimizing the necessity of caps 52.

Figure 3:
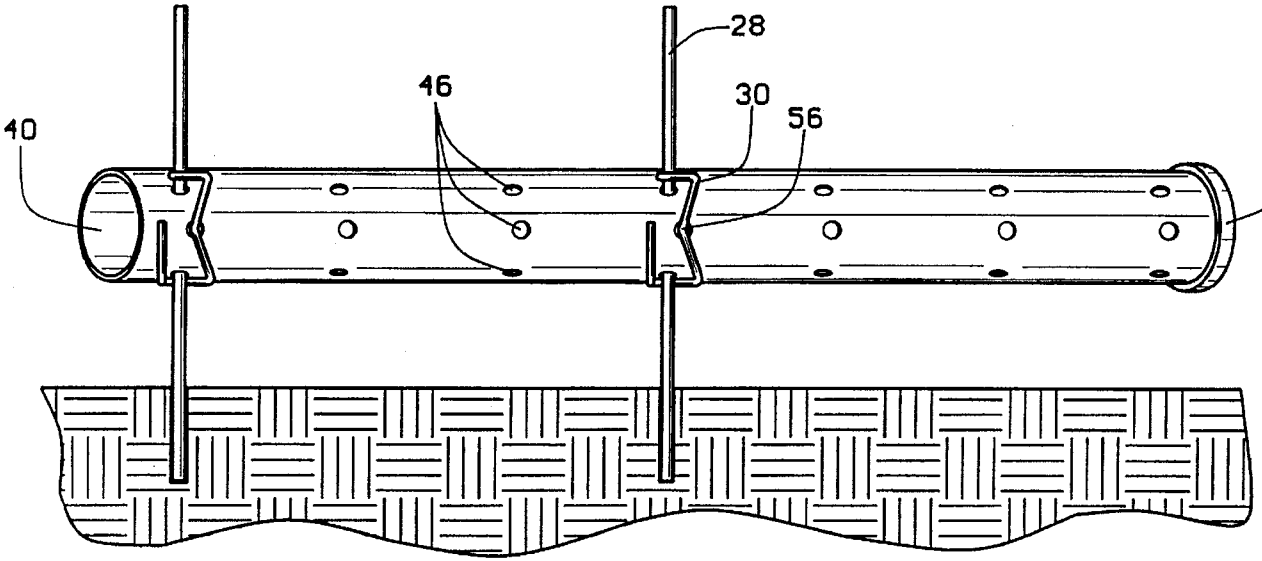
FIG. 3 is a side elevation view of one tube of the present invention focusing on the stake and clip combination securing the tube in spaced relation to the excavation bottom.

In the preferred embodiment, the stakes 28 are pieces of reinforcing bar (or another steel rod) commonly available in the construction field, and the stakes are inserted through one 30° hole and its corresponding 160° hole of the tube 24. The clip 30 is frictionally engaged with the stake and tube (as illustrated in FIGS. 2 and 3) thereby securing the stake relative to the tube. Preferably the clip includes a dimple 56 which meets the corresponding 90° hole when the clip and stake are frictionally engaged thereby also resiliently engaging the tube.

Figure 4:
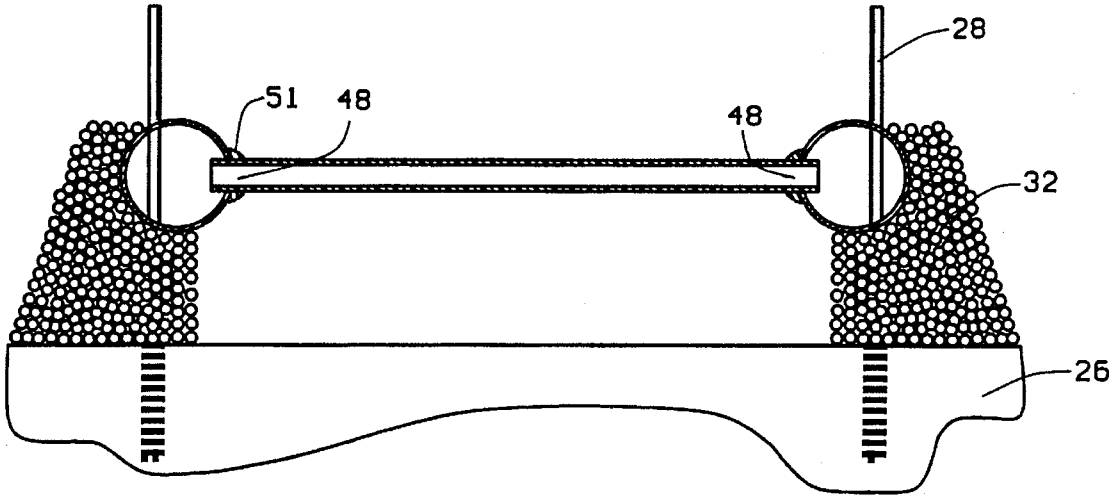
FIG. 4 is a cross-sectional view taken along lines 4—4 in FIG. 1 illustrating the cross over pipe snap fit into opposite tubes.
Figure 5:
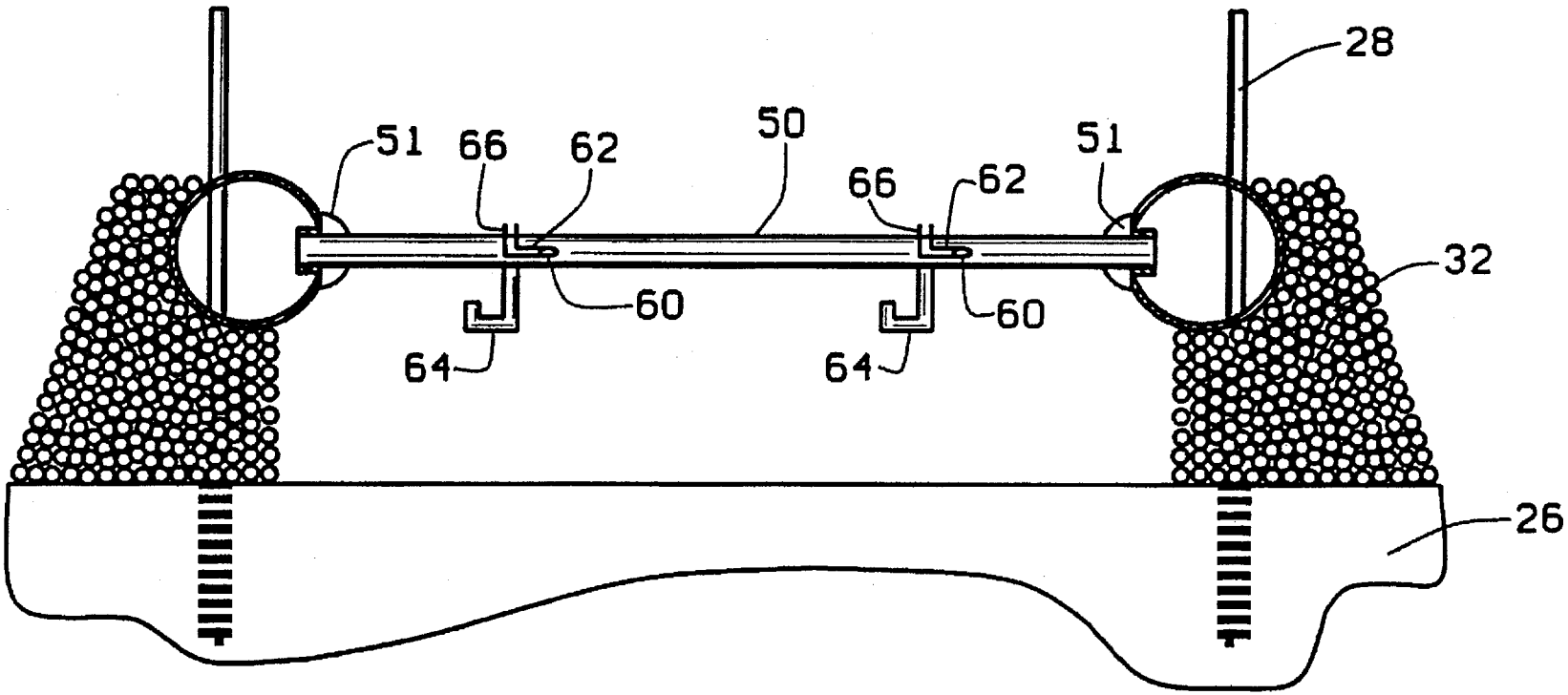
FIG. 5 is a cross-sectional view taken generally along lines 5—5 in FIG. 1 further illustrating two hooks (not shown in FIG. 1) mounted to the cross-over pipe which provide a mechanism to support reinforcing bar above the excavation bottom.

The preferred embodiment uses gravel 32 between the elevated tubes 24 and the excavation bottom 26 such that both the tubes 24 and the gravel 32 engage and form the concrete poured between walls 22. The gravel is preferably filled "to grade" (as shown in FIGS. 1 and 4) level with the top of the tubes 24 thereby providing a leach field for the longitudinal rows of holes 46 and enabling liquid adjacent the footing/foundation to drain through the tubes 24. It is understood that filler stone, rock, or another suitable material may be used in place of (or in combination with) the gravel 32 without departing from the scope of this invention.

While the tubes 24 are preferably hollow, the term "tube" as used herein shall refer to any elongated member which provides for end-to-end connection and accommodates being elevated above an excavation bottom with gravel filled therebetween. Specifically, the term tube includes a cylinder or plank configuration, whether or not said cylinder or plank is hollow. It is also to be understood that the term "excavation" as used herein may be a hole, trench, or other preparation of an earthen surface for receipt of a footing/foundation. Further, while the preferred embodiment uses a pair of spaced apart, serpentuitous walls 22, it is understood that a single wall 22 (constructed as described above) may be employed without departing from the spirit of this invention. Moreover, to minimize the risk of termites and the like, the tubes 24, elbows 44, stakes 28, and clips 30 are preferably constructed of non-degradable material.

In operation, the site laborer prepares an excavation 26 to the appropriate depth and dimensions to accommodate the desired footing/foundation form 20. The inside and/or outside corner points of the footing/foundation wall are surveyed and a string or chalk line is placed around the intending footing/foundation perimeter. The tubes 24 are laid such that the holes 46 face generally outward and the tube side containing the aperture or knock out 48 aligns with the footing/foundation perimeter. Elbows 44 are positioned and the tubes 24 are cut where appropriate to conform to the desired footing/foundation shape. Because footing/foundations are commonly 2-feet wide, the crossover pipe 50 is preferably 2 feet in length from flange to flange thereby properly spacing the tube 24 when the cross-over pipe 50 is coupled therebetween. Designing the cross-over pipe in this manner has several advantages. First, it eliminates the necessity to survey both parallel spaced apart walls 22. If one wall is carefully surveyed, the other wall may be correctly positioned by simply using the cross over pipe 50 as a spacing mechanism. Second, coupling the cross over pipe to opposite tubes 24 assures that the apertures 48 to which the cross over pipe is coupled are each at 270° (with respect to the male end) which in turn assures proper alignment of the three longitudinal row of holes 46 at their preferred 30°, 90°, and 150° positions.

Once the prior art tubes and elbows properly outlined around the footing/foundation perimeter as described above, stakes are placed through the 30° and 150° holes approximately every 5 feet. In the preferred embodiment two stakes are employed for each tube. One stake is positioned through the first set of holes from the male end and a second stake is positioned approximately 5 feet from the male end on each tube. The stakes are driven partially into the ground and the tubes are elevated "to grade". A typical footing/foundation is 8 inches deep therefore the tubes and elbows are raised such that they are 8 inches from the excavation bottom measured from their tops (i.e. 0° from the ends). As the tubes 24 and elbows 44 are elevated to grade, the clip 30 is frictionally and resiliently engaged to the stake and tube such that the tubes are properly secured "to grade". The tube/elbow elevation may also be adjusted by further driving selected stakes into, or pulling them partially out of, the ground without altering the relative relationship between each stake and clip combination. Gravel is then filled beneath the elevated tubes and elbows, and extends adjacent the holes 46 flush with the top of the tubes and elbows. At this point, the footing/foundation form is structurally complete. Any cross-over pipes 50 which were simply used as spacing mechanisms may be removed and caps 52 should be placed over all apertures 48 not coupled with a cross-over pipe 50. Concrete is then poured between the parallel spaced apart walls 22 thereby forming a footing/foundation having adjacent drainage and minimizing the draw backs of the prior art techniques.

Spacing the longitudinal row of holes 46 at 30°, 90°, and 150°, as in the preferred embodiment, provides several benefits in itself. This positioning allows the stakes 28 to be passed through corresponding 30° and 150° holes and driven into the excavation bottom 26 at substantially 90° with respect to excavation bottom. Driving the stake at substantially 90° minimizes misalignment of the walls 22 as they are elevated off of the excavation bottom which often occurs if the stakes are driven at a non-orthogonal angle. This annular hole arrangement also assures that two of the three rows 46 are at or below the horizontal central plane. Because gravel 32 is filled below the tubes 24, positioning multiple of the holes 46 at or below the horizontal plane allows fluid to enter the tubes from below thereby enabling expeditious drainage and allows silt/sediment to gravity flow from the tubes which minimizes the possibility of the tubes clogging over time. While not illustrated, the tubes may include a hole at 180° to enhance this benefit.

In an alternative embodiment, the cross-over pipe 50 is constructed with two sets of apertures 60 sized to accept one end 62 of a hook 64. The hook 64 also includes a half-circular shaped middle section 66. By positioning the apertures 60 substantially parallel to the excavation bottom, inserting the end 62 of hook 64 into the apertures and allowing the middle section 66 to rest atop the cross-over pipe 50, the hook 64 is supported above the excavation bottom providing an inexpensive and secure mechanism to support reinforcing bar (not shown) within the footing/foundation.

The preferred embodiment describes an excavation having a generally level bottom such that the Gravel 32 poured under and around the tubes 24 and elbows 44 rests on substantially the lowest plane of the excavation. However, without departing from the scope or spirit of this invention, the excavation bottom may be tiered or sloped such that the gravel 32 does not rest on the lowest plane of thereof.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. In a concrete form for retaining concrete poured about one side of the form and having at least one tube and a support that supports the tube in spaced-apart relation to an excavation bottom, an improvement comprising gravel between at least a portion of said tube and the excavation bottom such that the tube and the gravel are positioned to engage liquid concrete poured about one side of the form.

2. The form as in claim 1 wherein said gravel is located beneath substantially all of the tube.

3. The form as in claim 2 wherein said gravel fills substantially all of an area between the tube and the excavation bottom.

4. The form as in claim 3 wherein the tube is hollow with a first concrete engaging side and at least one aperture providing the form with integral drainage.

5. The form as in claim 4 wherein the gravel is adjacent said at least one aperture thereby providing a leach field for said tube.

6. The form as in claim 5 wherein said at least one aperture includes an aperture through bottom of said tube to enable silt within the tube to flow by gravitation therefrom.

7. A concrete form to retain concrete poured about one side of the form, said form comprising:

at least one hollow tube having a first exterior concrete engaging side and at least one aperture providing the form with integral drainage;

a support that supports the tube in spaced-apart relation to an excavation bottom;

gravel between at least a portion of said tube and the excavation bottom such that the tube and the gravel are positioned to engage said concrete, the ravel being located beneath substantially all of the tube and filling substantially all of an area between the tube and the excavation bottom;

wherein the support includes a stake having at least one slender end to facilitate driving the stake partially into the excavation bottom and a clip in frictional, resilient engagement with the stake and the tube to thereby secure the tube relative to the stake and support the tube in spaced-apart relation to the excavation bottom.

8. The form as in claim 7 wherein the support includes means for passing the stake through the tube exterior in at least two places and the clip includes means for engaging the stake in two separate places with a portion of the tube therebetween.

9. The form as in claim 8 wherein the passing means includes means for passing the stake through two preformed apertures.

10. The form as in claim 9 where said at least one aperture providing the form with integral drainage includes a plurality of apertures, two of which comprise the preformed apertures through which the stake passes.

11. The form as in claim 9 wherein the stake is a piece of reinforcing bar.

12. In a concrete footing/foundation form including an interior wall and an exterior wall each having at least one tube, an improvement comprising a support that elevates said at least one tube above an excavation bottom and gravel filled between the tube and the excavation bottom such that liquid concrete poured between the interior wall and the exterior wall engages the elevated tube as well as the gravel filled thereunder.

13. The form as in claim 12 wherein said at least one tube is hollow with a concrete engaging side and a plurality of apertures providing the form with integral drainage.

14. The form as in claim 13 wherein said plurality of apertures includes at least one aperture facing substantially downward thereby allowing sediment within the tube to gravity flow out of the tube and into the gravel fill.

15. The form as in claim 13 wherein said gravel is filled substantially to grade thereby providing a leach field to the apertures of said hollow tubes.

16. The form as in claim 15 including a connector connecting a plurality of tubes in end-to-end configuration, said connector including at least one elbow for each of said interior and exterior walls to enable construction of serpentuitous parallel walls.

17. In a concrete footing/foundation form including an interior and an exterior wall each having at least one tube, an improvement comprising means for elevating said at least one tube above an excavation bottom and gravel filled between the tube and the excavation bottom such that concrete poured between the walls engages the elevated tube as well as the gravel filled thereunder, said at least one tube is hollow with a concrete engaging side and a plurality of apertures providing the form with an integral drainage, and a cross over pipe providing fluid communication between the interior and exterior walls and at least one hook coupled with the cross over pipe such that a reinforcing bar coupled with said at least one hook is elevated above the excavation bottom.

18. A method of constructing a concrete form for retaining liquid concrete poured about one side thereof, the method including the steps of:

excavating a concrete receiving area;

elevating a tube above a bottom of the excavation; and filling gravel between at least a portion of said excavating bottom and said elevated tube such that the tube and the gravel are both in position to engage said poured liquid concrete.

19. The method according to claim 18 wherein the step of filling gravel includes filling gravel between substantially all of the elevated tube and the excavation bottom.

20. A method of constructing a concrete form for retaining concrete poured about one side thereof, the method including the steps of:

excavating a concrete receiving area;

elevating a tube above a bottom of the excavation; an filling gravel between at least a portion of said excavation bottom and said elevated tube such that the tube and the gravel are both in position to engage said poured concrete, the gravel being filled between substantially all of the elevated tube and the excavation bottom;

wherein the step of elevating the tube includes the steps of elevating the tube to grade and supporting the tube thereat.

21. The method according to claim 20 wherein the step of supporting the tube at grade includes the steps of driving a stake partially into the excavation bottom and securing the tube to the stake such that the tube remains at grade.

22. The method according to claim 21 wherein the step of securing the frame includes the step of fractionally, resiliently engaging the stake to the frame with a clip.

23. A concrete form to retain concrete poured about one side of the form, said form comprising:

at least one tube;

a support that supports the tube in spaced-apart relation to an excavation bottom, the support including a stake having at least one slender end to facilitate driving the stake partially into the excavation bottom and a clip in frictional, resilient engagement with the stake and the tube to thereby secure the tube relative to the stake and support the tube in spaced-apart relation to the excavation bottom; and gravel between at least a portion of said tube and the excavation bottom such that the tube and the gravel are positioned to engage said concrete.

24. In a concrete footing/foundation form including an interior and exterior wall each having at least one tube, an improvement comprising:

a support elevating said at least one tube above an excavation bottom and gravel filled between the tube and the excavation such that concrete poured between the walls engages the elevated tube as well as the gravel filled thereunder; and a cross over pipe providing fluid communication between the interior and exterior walls and at least one hook coupled with the cross over pipe such that a reinforcing bar coupled with said at least one hook is elevated above the excavation bottom.

25. A method of constructing a concrete form for retaining concrete poured about one side thereof, the method including the steps of:

excavating a concrete receiving area;

elevating a tube above the excavation bottom; and filling gravel between at least a portion of said excavation bottom and said elevated tube such that the tube and the gravel are both in position to engage said poured concrete;

wherein the step of elevating a tube above the excavation bottom includes the steps of elevating the tube to grade and supporting the tube thereat.

* * * * *